US010471335B2

(12) United States Patent
Rice

(10) Patent No.: US 10,471,335 B2
(45) Date of Patent: Nov. 12, 2019

(54) SNOWBOARD APPARATUS OR ACCESSORY

(71) Applicant: Travis Rice, Jackson Hole, WY (US)

(72) Inventor: Travis Rice, Jackson Hole, WY (US)

( * ) Notice: Subject to any disclaimer, the term of this patent is extended or adjusted under 35 U.S.C. 154(b) by 0 days.

(21) Appl. No.: 14/815,731

(22) Filed: Jul. 31, 2015

(65) Prior Publication Data

US 2016/0030830 A1 Feb. 4, 2016

Related U.S. Application Data

(60) Provisional application No. 62/031,700, filed on Jul. 31, 2014.

(51) Int. Cl.

| | |
|---|---|
| ***A63C 11/20*** | (2006.01) |
| ***A63C 10/28*** | (2012.01) |
| ***A63C 5/06*** | (2006.01) |
| *A63C 5/00* | (2006.01) |
| *A63C 5/03* | (2006.01) |
| *A63C 10/06* | (2012.01) |
| *A63C 10/14* | (2012.01) |

(52) U.S. Cl.

CPC ..... *A63C 10/28* (2013.01); *A63C 5/06* (2013.01); *A63C 11/20* (2013.01); *A63C 5/003* (2013.01); *A63C 5/03* (2013.01); *A63C 10/06* (2013.01); *A63C 10/14* (2013.01)

(58) Field of Classification Search

CPC ..... A63C 5/062; A63C 5/003; A63C 5/006; A63C 5/052; A63C 10/26; A63C 10/28; A63C 10/285; A63C 11/18; A63C 11/20; A63C 10/14; A63C 10/145; B63B 35/812

See application file for complete search history.

(56) References Cited

U.S. PATENT DOCUMENTS

| | | | | | |
|---|---|---|---|---|---|
| 3,727,934 | A * | 4/1973 | Averbook | A63C 11/006 | 280/814 |
| 3,897,839 | A * | 8/1975 | Brisebois | B62M 27/02 | 180/190 |
| 4,180,275 | A * | 12/1979 | Montoya | A63C 5/062 | 280/28 |
| 4,900,061 | A * | 2/1990 | Kozma, Jr. | A63C 11/18 | 280/813 |
| 5,042,839 | A * | 8/1991 | Ciari | A63C 11/18 | 15/237 |
| 5,172,924 | A * | 12/1992 | Barci | A63C 5/003 | 280/14.22 |
| 5,346,244 | A * | 9/1994 | Le Masson | A63C 5/04 | 280/607 |

(Continued)

FOREIGN PATENT DOCUMENTS

| | | | | |
|---|---|---|---|---|
| JP | WO 2011099155 A1 | * | 8/2011 | A63C 5/02 |
| WO | WO8303554 | * | 10/1983 | |

*Primary Examiner* — Emma K Frick

(57) ABSTRACT

The present invention comprises a fairing apparatus for a snowboard comprising a raised structure that may be positioned adjacent to the user's binding, having a geometry that deflects snow or ice away from the user's bindings and boots. In various exemplary embodiments, the raised structure may comprise two forward extending ridges located near the edges of the snowboard. In various exemplary embodiments, the forward extending ridges may extend laterally beyond the edges of the snowboard and may generate lift as the apparatus moves through snow or ice.

5 Claims, 10 Drawing Sheets

(56) References Cited

U.S. PATENT DOCUMENTS

| | | | | | |
|---|---|---|---|---|---|
| 5,427,401 | A * | 6/1995 | Liard | A63C 5/07 | 280/602 |
| 5,573,264 | A * | 11/1996 | Deville | A63C 5/03 | 280/14.22 |
| 6,007,394 | A * | 12/1999 | Kagan | B63B 35/812 | 441/70 |
| 6,481,741 | B1 * | 11/2002 | Porte | A63C 5/03 | 280/14.21 |
| 6,505,841 | B1 * | 1/2003 | Kessler | A63C 10/14 | 280/14.21 |
| 8,246,070 | B2 * | 8/2012 | Lin | A63C 5/03 | 280/11.14 |
| 8,286,989 | B2 * | 10/2012 | Wasserman | A63C 7/108 | 280/14.22 |
| 8,419,043 | B2 * | 4/2013 | Fournier | A63C 5/003 | 280/14.22 |
| 8,910,966 | B1 * | 12/2014 | Rogers | A63C 5/06 | 280/602 |
| 9,108,103 | B2 * | 8/2015 | Nobil | A63C 11/20 | |
| 2005/0253347 | A1 * | 11/2005 | Martin | A63C 10/14 | 280/14.22 |
| 2009/0289439 | A1 * | 11/2009 | Carpenter | A63C 10/14 | 280/618 |
| 2011/0248457 | A1 * | 10/2011 | Kosmehl | A63C 5/003 | 280/14.22 |

* cited by examiner

SNOWBOARD APPARATUS OR ACCESSORY

This application claims the benefit of U.S. Provisional Patent Application No. 62/031,700 filed on Jul. 31, 2014, which is hereby incorporated by reference in its entirety as if set forth herein.

BACKGROUND OF THE INVENTION

Field of the Invention

The invention relates generally to the field of action sports equipment. In particular, the invention relates to a apparatus or accessory for creating lift and reducing drag on the top surface of various board-riding equipment such as snowboards, snow skis, as well as other types of equipment such as wakeboards and kiteboards.

Description of Related Art

The present invention is in the field of action sports. More particularly, the invention is in the field of board riding sports including snowboarding, skiing, wakeboarding, kiteboarding, etc. The various embodiments described herein are presented with respect to a snowboard, but the same concepts can be applied to such other board sports and types of boardriding equipment.

Conventional snowboard design applies a 2-dimensional approach to the interaction between the board-bindings-boots and the slope, focusing on the interaction between the base and edges of the board and the surface of the snow. However, on any surface other than hardpack, the interaction between the board-binding-boots and the snow is 3-dimensional as snow and ice pass onto and across the top surface of the board and into the bindings and boots. This is particularly true in powder conditions, where the board, bindings, and boots are often completely submerged in the snow.

Currently, as the snowboard traverses a mountain, snow and ice build up on the top surface of the board, the bindings, and the boots, causing the board to become heavier and slower to react. Depending on conditions and type of snow, a rider can often accumulate anywhere from a 0.5 pound to 30-plus pounds of snow cover on the board, dramatically impacting speed and responsiveness.

Similarly, when the snowboard is keeled over on its edge in powder conditions the bindings can create substantial drag. The majority of this drag is on the heel side in typical binding configurations, but a significant amount of drag can also be generated on the toe side.

The present invention addresses these issues, in various embodiments reducing drag and providing lift to improve performance in a range of different conditions.

SUMMARY OF THE INVENTION

The present invention comprises a fairing or foil apparatus for a board comprising a raised structure that may be positioned forward of the user's front binding or in various other locations on the top surface of the board, having a geometry that deflects snow, water, or ice away from the user's bindings and boots and generates lift to improve performance. In various exemplary embodiments, the raised structure may comprise two forward extending ridges located near the edges of the snowboard. In various exemplary embodiments, the forward extending ridges may extend laterally beyond the edges of the snowboard and may generate lift as the apparatus moves through snow or ice.

In various exemplary embodiments, the fairing may be made of a polymer or composite material. In various exemplary embodiments, the fairing may be attached to the snowboard binding or integrated with the snowboard binding. In various exemplary embodiments, the fairing may be generally trapezoidal in shape, generally square in shape, or generally triangular in shape.

In various exemplary embodiments, the fairing apparatus for a snowboard may comprise a raised structure positioned adjacent to one of the user's bindings having a geometry that deflects snow or ice away from the user's bindings and boots.

DETAILED DESCRIPTION OF THE PREFERRED EMBODIMENTS

Figure 1:
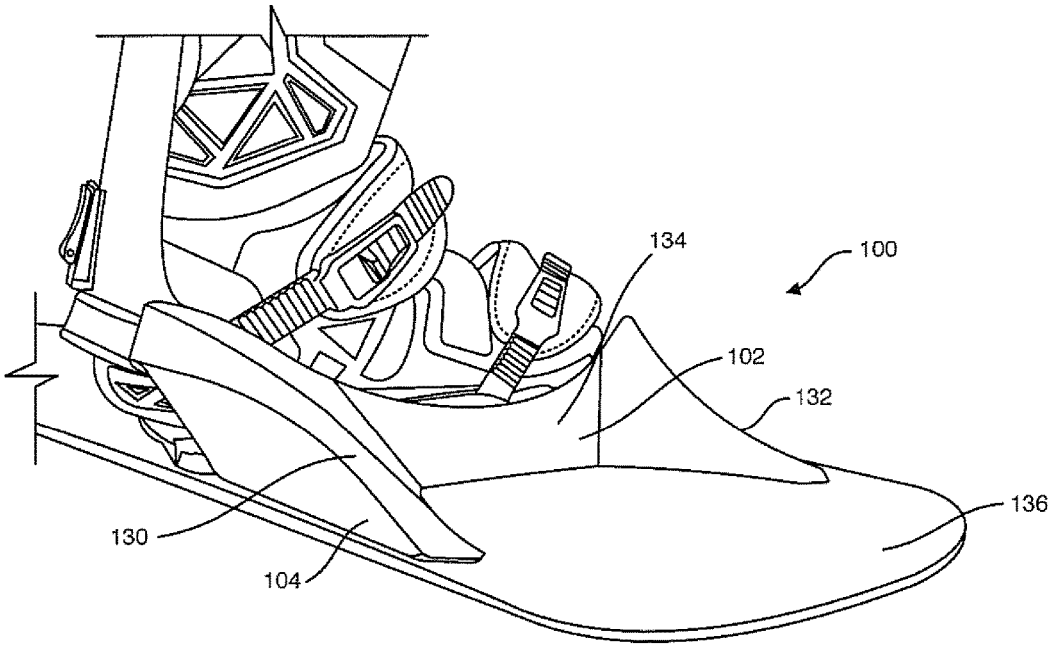
FIG. 1 is a front perspective view of an exemplary embodiment of a fairing as disclosed herein attached to a typical snowboard binding.
Figure 2:
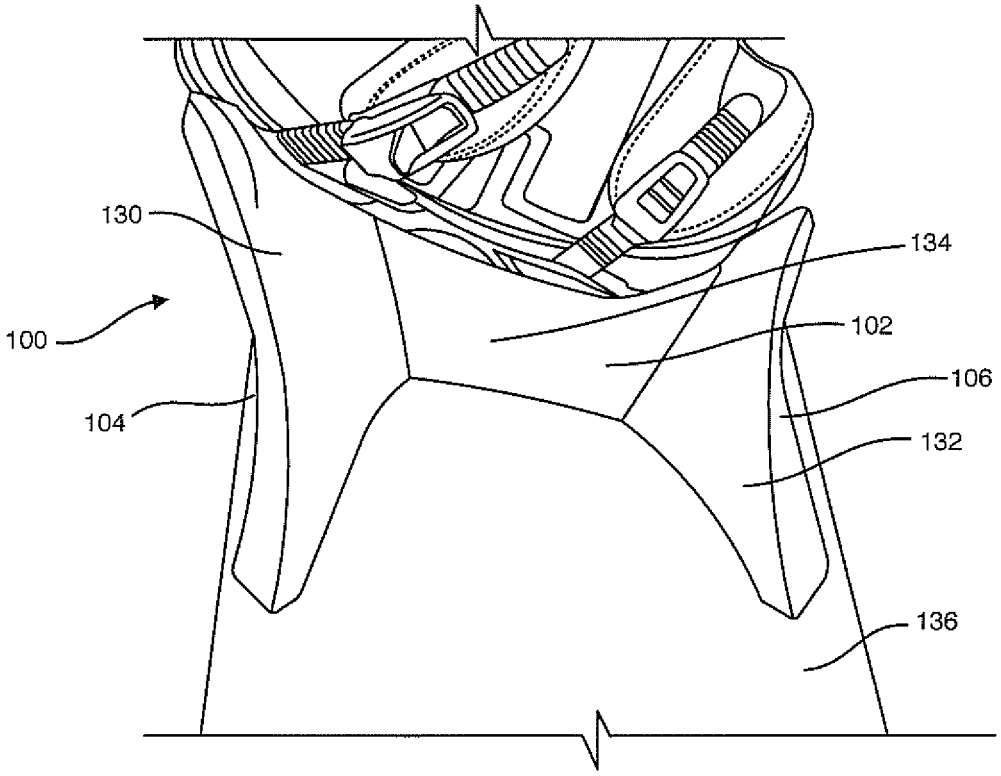
FIG. 2 is a top front perspective view of an exemplary embodiment of a fairing as disclosed herein attached to a typical snowboard binding on a snowboard.
Figure 3:
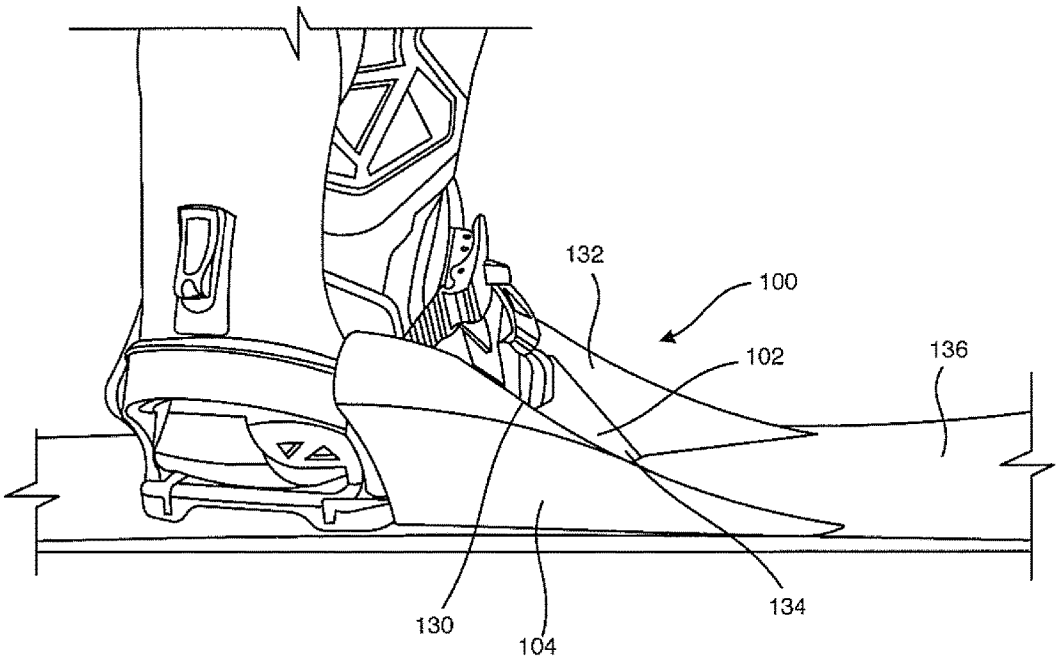
FIG. 3 is a side perspective view of an exemplary embodiment of a fairing as disclosed herein attached to a typical snowboard binding on a snowboard.
Figure 4:
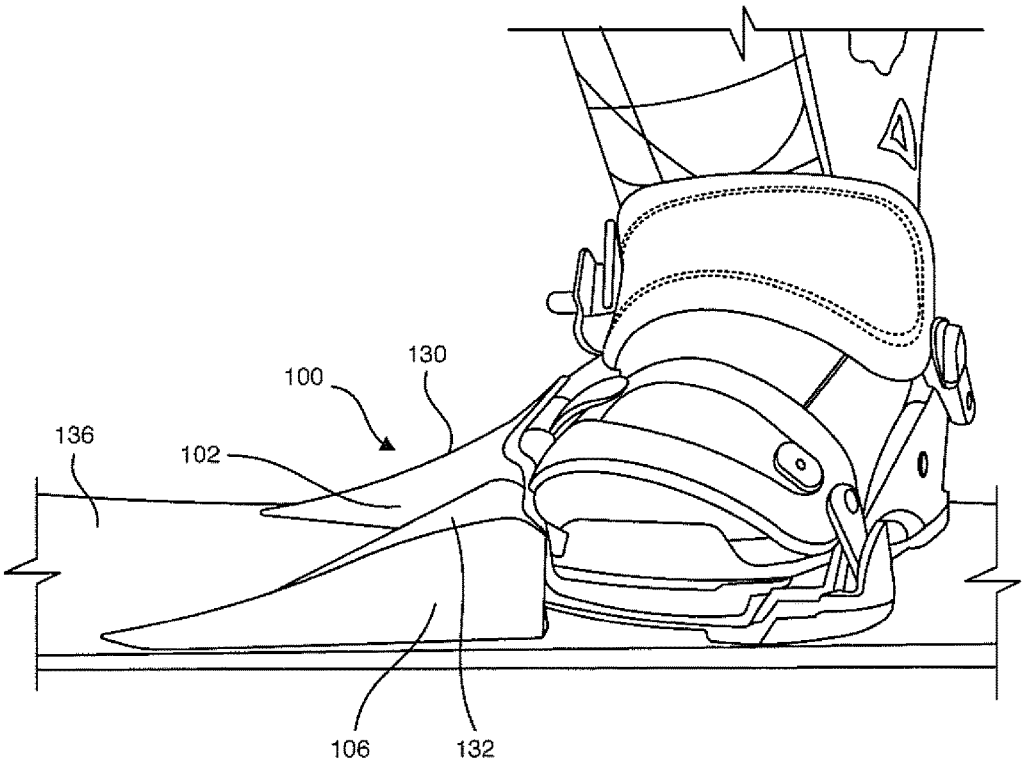
FIG. 4 is a side perspective view of an exemplary embodiment of a fairing as disclosed herein attached to a typical snowboard binding on a snowboard.
Figure 5:
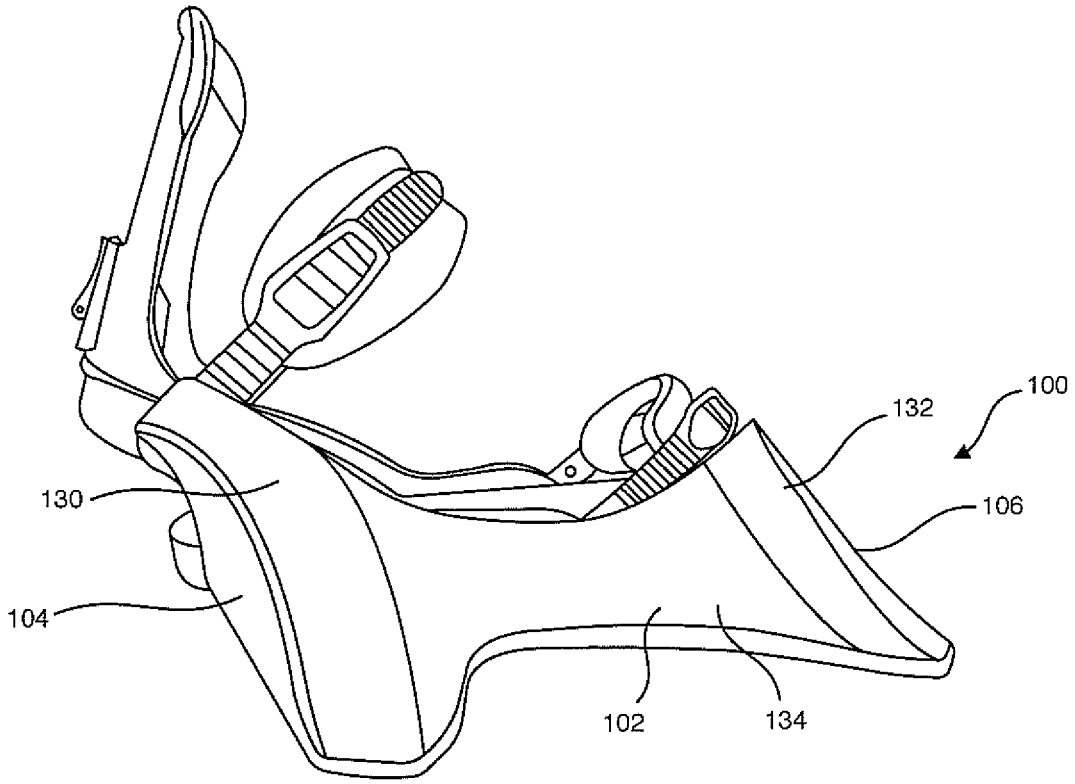
FIG. 5 is a front perspective view of an exemplary embodiment of a fairing as disclosed herein attached to a typical snowboard binding.
Figure 6:
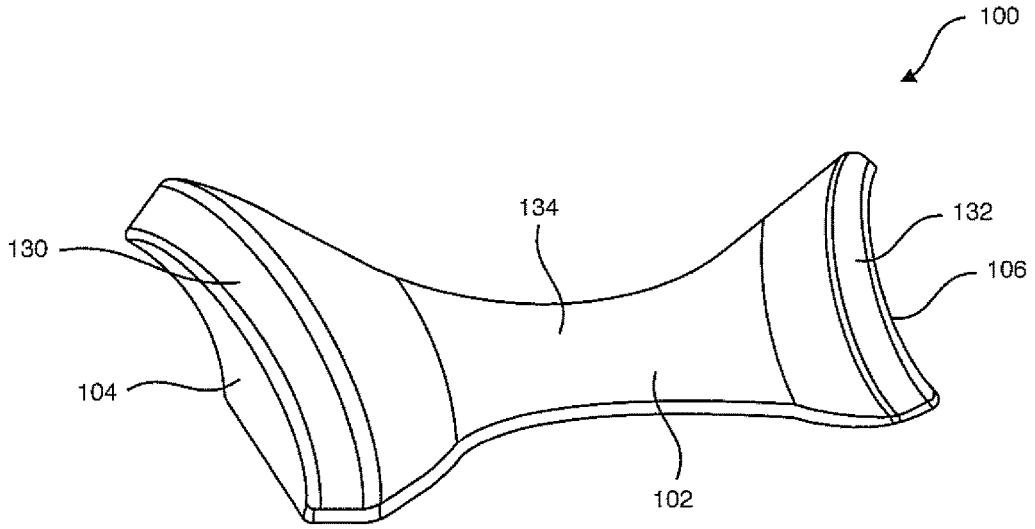
FIG. 6 is a front perspective view of an exemplary embodiment of a fairing as disclosed herein.

The following description is presented to enable any person skilled in the art to make and use the invention. For purposes of explanation, specific nomenclature is set forth to provide a thorough understanding of the present invention. Descriptions of specific embodiments or applications are provided only as examples. Various modifications to the embodiments will be readily apparent to those skilled in the art, and general principles defined herein may be applied to other embodiments and applications without departing from the spirit and scope of the invention. Thus, the present invention is not intended to be limited to the embodiments shown, but is to be accorded the widest possible scope consistent with the principles and features disclosed herein.

The present invention is a fairing or foil structure on the top surface of the snowboard, ski, wakeboard, waterski, or other board that reduces drag during use. In various exemplary embodiments, such a structure can present an improved hydrodynamic profile, deflect snow, ice, or water off the top surface of the board and various surfaces of the user's bindings and boots, and/or use foil effects to reduce draft and create lift as it passes through snow or water. It is important to understand that while various exemplary embodiments of the present invention are shown here as accessories or attachments to the board and/or bindings, the types of structures that comprise the present invention can also be fully integrated into the board and/or bindings.

While the term fairing will be used throughout this description, it will be understood by those skilled in the art that the invention may provide both the streamlining and drag reduction of a fairing and lift commonly associated with a foil structure.

Referring to FIGS. 1 through 4, an exemplary embodiment of the present invention that both deflects snow and ice and creates foil effects on the toe and heel sides is shown attached to a typical snowboard binding on a snowboard. A fairing 100 is shown having generally a top surface 102 that creates improved hydrodynamic performance and side surfaces 104 and 106 that are shaped to deflect snow and ice off and create foil effects as the fairing passes through the snow. When viewed from above as in FIG. 2, fairing 100 has a generally U-shaped geometry with forward extending ridges 130, 132 on each side of a generally recessed, angled, lower center section 134. The ridges 130, 132 may be symmetrical or may form an asymmetrical design with one ridge extending farther forward and/or higher or lower than the other.

As shown in FIGS. 1 through 7, in various exemplary embodiments, the ridges 130, 132 may be curved or shaped to extend up and out from the top surface of the snowboard 136 such that the side surfaces 104, 106 provide a foil that produces lift under certain conditions as it moves through the snow. Such side surfaces create additional surface area and can be specifically designed and oriented to provide lift, particularly in powder snow to allow the rider more easily keep the board on top of or near the surface. The precise shape, dimensions, proportions, and orientation of the fairing 100 and all of its particular features can be varied to calibrate performance to user preferences, conditions, type of riding, etc.

In various exemplary embodiments where the fairing 100 is not integrated into the board or the binding, the bottom surface of fairing 100 provides the interface with the board, while the rear surface interfaces with the binding. As noted above, the fairing 100 can also be integrated with the board and/or binding, which would effectively eliminate these bottom and rear interface surfaces.

Referring to FIGS. 5 through 8, alternative exemplary embodiments of the fairing 100 are shown having the same basic U-shaped geometry but with different dimensions, angles, curves, and proportions.

In various exemplary embodiments, the fairing 100 may be positioned immediately forward of and/or behind the front and/or rear bindings. The top surface 102 of the fairing may be shaped into a wide variety of different geometries to effectively deflect snow and ice up and off the board and/or out to the sides of the binding and boots. Referring to FIGS. 1-10, in various exemplary embodiments, the top surface 102 may generally slope upward from the front to back. In various exemplary embodiments, the fairing 100 may extend approximately across the entire width of the board or across only a portion of the board, and may be adjustable to accommodate different board widths.

Figure 9:
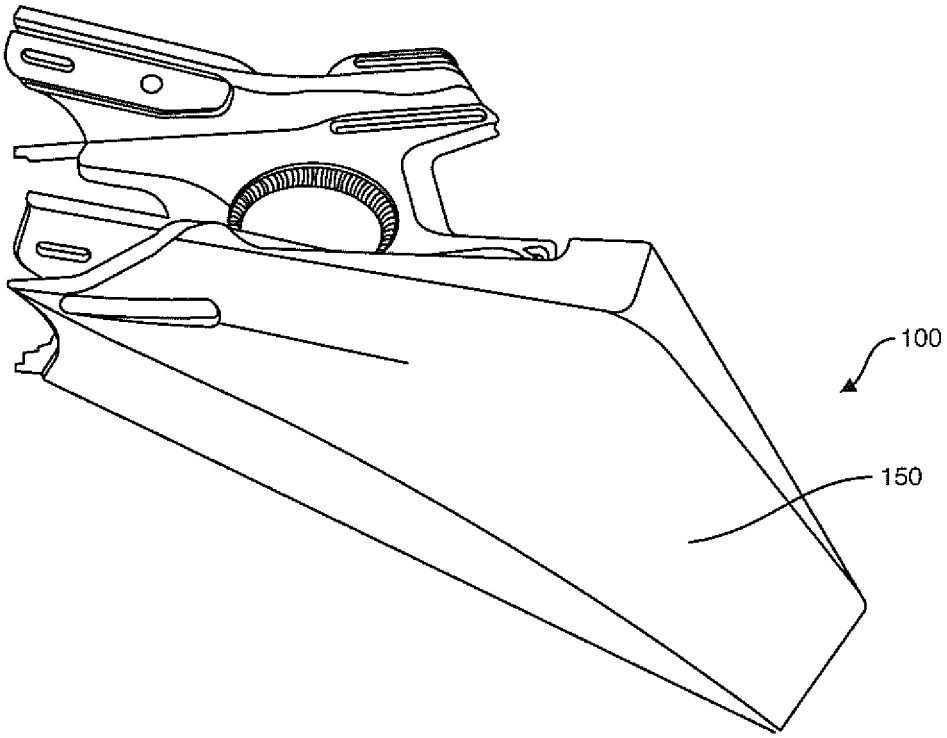
FIG. 9 is a front perspective view of an exemplary embodiment of a fairing as disclosed herein attached to a typical snowboard binding.

Referring to FIG. 9, an alternate exemplary embodiment is shown of a fairing 100 having a generally trapezoidal wedge shape. The angled generally planar top surface 150 of the fairing 100 improves hydrodymanic performance as the board moves through the snow or water, and deflects snow and ice off the board to reduce buildup on the top surface of the board. Other wedge shaped geometries can also be used for the fairing, including without limitation generally square, triangular, or curvilinear geometries. Again, the precise shape, dimensions, proportions, and orientation of the fairing 100 and all of its particular features can be varied to calibrate performance to user preferences, conditions, type of riding, etc.

Figure 10:
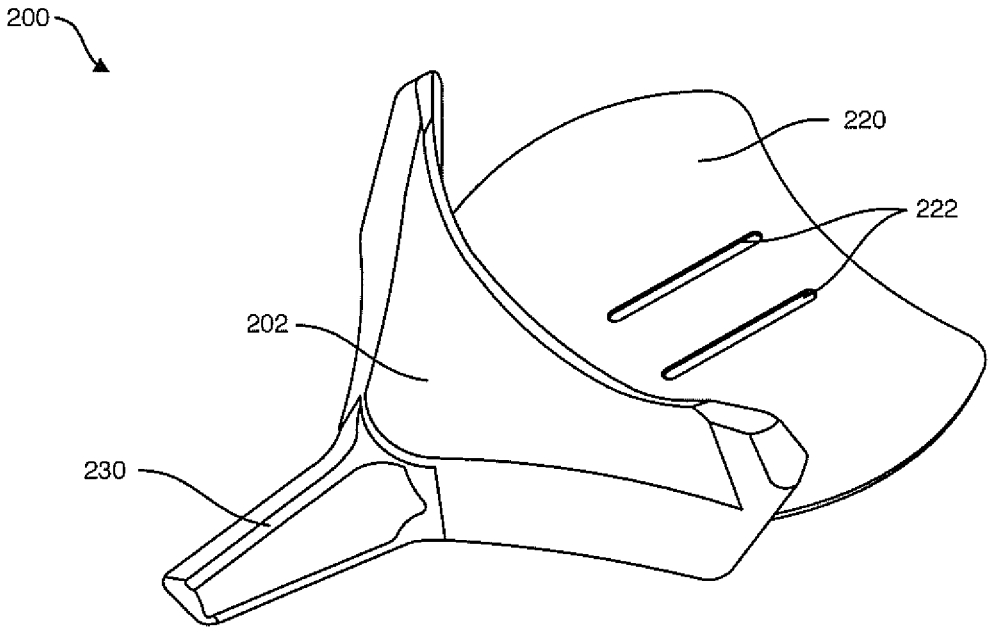
FIG. 10 is a front perspective view of an exemplary embodiment of a fairing as disclosed herein.

Referring to FIG. 10, in various alternative exemplary embodiments a fairing 200 may have a geometry shaped to deflect snow and ice off to the sides of the board and bindings as it moves through the snow. Such embodiments may include a ridge 230 that extends forward and is shaped to redirect snow and ice of the board laterally, to the sides of the users boots and bindings.

In various exemplary embodiments, the fairing disclosed herein may be made of plastic materials including polymers or other composite materials such as carbon fiber composites sufficiently rigid and strong enough to deflect snow and other materials away from the binding and boots of the snowboard, while still allowing flex and articulation as to not disrupt the flex pattern of the board. In various exemplary embodiments, the fairing disclosed herein may be formed of one or more components, and may include seams, hinges, or flexible features to provide for adjustment to suit a variety of different board and/or binding configurations.

In various exemplary embodiments, the fairing may be a solid block of material, or it may be hollow or partially hollow. In various exemplary embodiments, the fairing may be a sealed hollow body having an empty air space inside to further provide lift as the device moves through snow or water.

Figure 7:
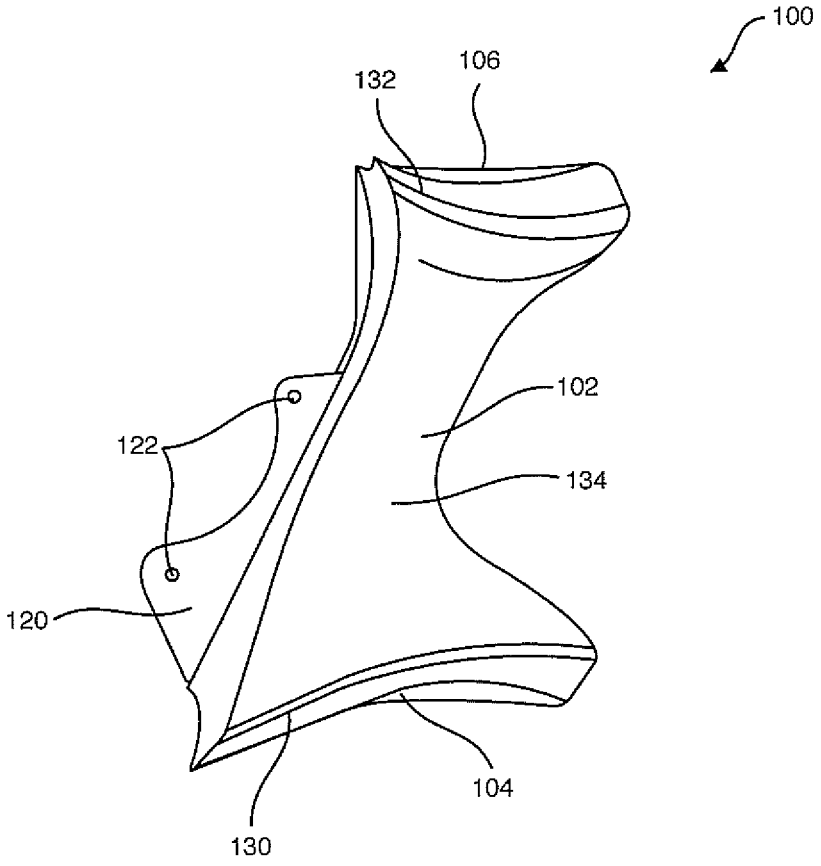
FIG. 7 is a rear perspective view of an exemplary embodiment of a fairing as disclosed herein.
Figure 8:
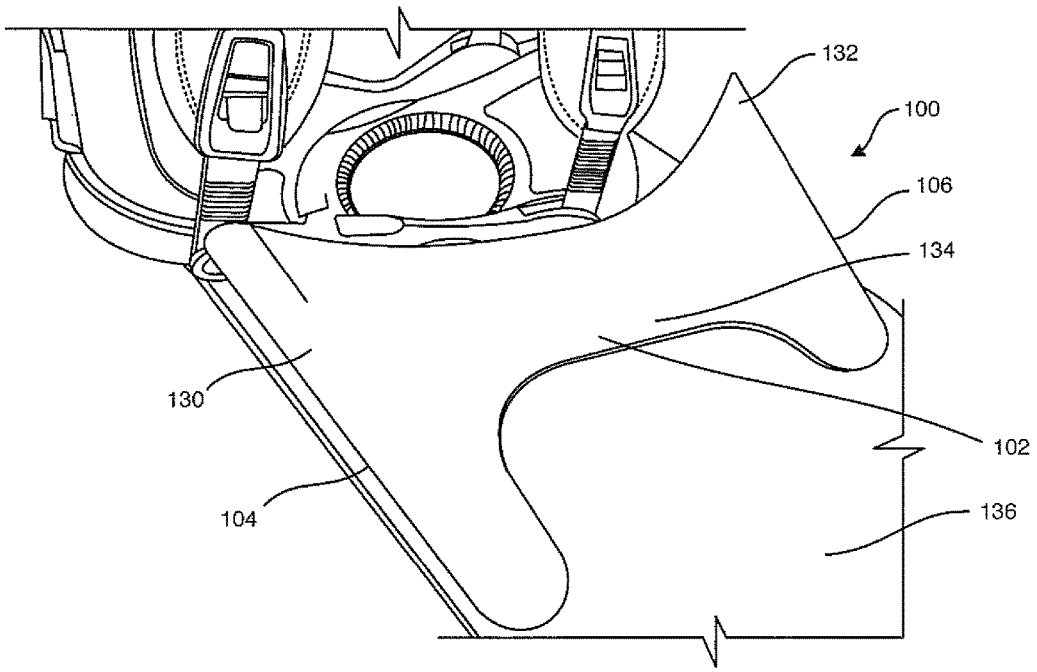
FIG. 8 is a front perspective view of an exemplary embodiment of a fairing as disclosed herein attached to a typical snowboard binding on a snowboard.

As seen in FIGS. 7 and 10, in various exemplary embodiments a flange 120, 220 can be provided on the bottom surface of the fairing to facilitate attachment to the board and/or bindings using any suitable technique. Holes or slots 122, 222 may be provided to accommodate fasteners such as screws for attachment to the board and/or binding, and allow for adjustment of the angle or position of the fairing 100, 200.

The advantages of the present invention include, without limitation, the application of hydrodynamics to help the snowboard go faster, achieve greater control, keep momentum through turns, and allow the rider to traverse at angles closer to 90 degrees to the fall line of the slope. The present invention may be applied in a variety of combinations: (a) in front and behind the front foot of the snowboard user; (b) in front and behind the back foot of the snowboard user; and (c) any combination thereof.

What is claimed is:

1. A fairing apparatus for a snowboard comprising, a fairing structure affixed to a snowboard binding configured to be attached to a snowboard, the fairing structure configured so that a bottom surface of the fairing structure is in contact with a top surface of the snowboard when the snowboard binding is attached to the snowboard, the fairing structure affixed in a position forward of the snowboard binding, the fairing structure having a top surface that slopes downward away from the snowboard binding such that it will deflect snow away from the snowboard binding when snowboarding, the fairing structure comprising two forward extending ridges located near the edges of the snowboard;

the forward extending ridges extending laterally beyond the edges of the snowboard.

2. The apparatus of claim 1, wherein the forward extending ridges generate lift as the apparatus moves through snow.

3. The apparatus of claim 1, wherein the fairing structure is made of a polymer or composite material.

4. The apparatus of claim 1, wherein the fairing structure is attached to the snowboard binding.

5. The apparatus of claim 1, wherein the fairing structure is integrated with the snowboard binding.

* * * * *